United States Patent [19]

Belangie

[11] Patent Number: 4,927,291

[45] **Date of Patent: * May 22, 1990**

[54] JOINT SEAL FOR CONCRETE HIGHWAYS

[76] Inventor: Michael C. Belangie, 27 Q St., Salt Lake City, Utah 84103

[ * ] Notice: The portion of the term of this patent subsequent to Apr. 25, 2009 has been disclaimed.

[21] Appl. No.: 189,631

[22] Filed: May 3, 1988

Related U.S. Application Data

[63] Continuation-in-part of Ser. No. 1,699, Jan. 9, 1987, Pat. No. 4,824,283.

[51] Int. Cl.[5] ..... E01C 11/10

[52] U.S. Cl. ..... 404/64; 404/66; 404/74

[58] Field of Search ..... 404/64–68, 404/47, 49, 74; 52/396

[56] References Cited

U.S. PATENT DOCUMENTS

| | | | |
|---|---|---|---|
| 1,885,391 | 11/1932 | Thompson et al. | 404/49 |
| 3,629,986 | 12/1971 | Klittich | 404/64 |
| 3,827,204 | 8/1974 | Walters | 404/66 |
| 3,866,384 | 2/1975 | Peterson, Jr. et al. | 404/74 |
| 3,870,424 | 3/1975 | Koester et al. | 404/67 |
| 4,127,350 | 11/1978 | Weber | 404/65 |
| 4,285,612 | 8/1981 | Betti | 404/68 |
| 4,287,696 | 9/1981 | Mullen | 404/64 |
| 4,601,604 | 7/1986 | Clark et al. | 404/69 |
| 4,699,540 | 10/1987 | Gibbon et al. | 404/49 |
| 4,784,516 | 11/1988 | Cox | 404/69 |
| 4,817,963 | 4/1989 | Munden et al. | 404/64 X |
| 4,824,283 | 4/1989 | Belangie | 404/64 |

FOREIGN PATENT DOCUMENTS

| | | | |
|---|---|---|---|
| 644713 | 4/1937 | Fed. Rep. of Germany | 404/67 |

OTHER PUBLICATIONS

"Wide Top Cut Features Slab Joints" Engineering News Record, Mar. 16, 1961, p. 49.

*Primary Examiner*—Jerome W. Massie, IV
*Assistant Examiner*—Matthew Smith
*Attorney, Agent, or Firm*—Mallinckrodt & Mallinckrodt

[57] ABSTRACT

A sealed joint in a concrete highway or the like is installed in a channel formed above the usual shrinkage control cut or construction joint between adjoining concrete slabs by placing in such channel a preformed and relaxed length of a ductile and elastic material and bonding it to at least part of the concrete faces of the channel by a ductile and elastic adhesive. In some instances, an anti-bonding agent is applied to portions of the preformed and relaxed length to provide for joint expansion and retraction. The joint installation channel is preferably unusually shallow and may be dry cut. Its width is sufficiently narrow that traffic loads are carried by the concrete bordering the channel. The preformed length is preferably of strip formation, which is introduced into the channel from a stable roll of same.

12 Claims, 2 Drawing Sheets

JOINT SEAL FOR CONCRETE HIGHWAYS

PRIOR APPLICATION

The present application is a continuation-in-part of my similarly entitled application Ser. No. 07/001,699, filed Jan. 9, 1987, now patent No. 4,824,283 issued Apr. 25, 1989.

BACKGROUND OF THE INVENTION

1. Field

The invention is in the field of weather and/or traffic resistant joints between adjoining structural slab materials, especially in concrete highways, and of methods of making same.

2. State of the Art

Many different ways of making joints of the type concerned have been proposed heretofore to overcome the various problems associated with interconnecting adjoining slab materials. Of special concern has been the providing of both weather and traffic resistant expansion joints in concrete highways.

It has become common practice to cut expansion joint channels transversely and/or longitudinally in a concrete highway above the usual shrinkage control cuts or construction joints by the use of diamond saws, and to introduce a more or less hard-setting but ductile and elastic silicone adhesive into such channel cuts as a joint filler above a semi-rigid backer bar insert. As a weather proofing agent, the adhesive will adhere to the opposed concrete facings of such cuts and after curing into final hardness will tend to move with the expanding and contracting adjoining concrete slabs. It is usual to clean the channel cuts by flushing with water followed by high pressure water blast or sand blast prior to introducing the silicone adhesive. Although certain silicone formulations designated for highway use are presently available commercially from several manufacturers on the basis of long-range testing showing several years of generally trouble-free performance under heavy traffic conditions, the reduction of costs associated with the construction and replacement of such joints, together with improvements in performance, have been the subject of considerable research activity by government highway departments and by supplies of materials thereto considering the tremendous number of such joints necessitated by the many miles of concrete highway in most countries of the world. Other types of field-cured elastomeric materials as well as preformed and precompressed lengths of various elastomer materials have been introduced into joint installation channels for sealing purposes with only indifferent success.

SUMMARY OF THE INVENTION

In accordance with the present invention, improvements in cost and performance are attainable by a combination of a ductile and elastic adhesive, usually but not necessarily a field-cured silicone, with a preformed and relaxed length of a ductile and elastic material, usually but not necessarily a heat-cured silicone, in an installation channel that is cut or otherwise provided in the concrete at and above the usual shrinkage-control cut or construction joint. Such preformed length is usually and preferably of strip form. The installation channel is sufficiently narrow that traffic loads are carried by the concrete bordering such channel. Although a somewhat similar preformed waterstop is shown by Weber U.S. Pat. No. 4,127,350 of Nov. 28, 1978 in combination with a covering of a rigid-setting grout material serving as both a filler and a hold-down for the waterstop, the installation is in a concrete highway expansion joint channel of width such that the grout, which extends upwardly in the channel to flush with the highway surface, bears traffic loads.

In the present invention, the preformed length rests on and may be surrounded by adhesive material. It is usually covered, at least laterally, by the adhesive material. With ordinary concrete, an intermediate portion of the width of the preformed relaxed length that extends over the shrinkage control cut has an anti-bonding material applied thereto on both upper and lower faces, so as to provide upper and lower movement areas free of bond with the adhesive material to accommodate expansion and contraction of such length. Such ordinary concrete usually has voids at the faces of the expansion joint channel due either to voids in the concrete as cast or to spalling off of material at such faces as the channel is cut. Enough of the adhesive material should be applied to fill such voids as well as to provide the necessary adhesive for the preformed length of material inserted in the installation channel. This inevitably provides a rather thick coating of the adhesive material over at least the margins of the top surface of the preformed length and often over the entire top surface area. The adhesive material underneath normally penetrates into the shrinkage control cut or construction joint and forms an unbroken layer below the preformed length. So that such a full covering of the top surface of the preformed length by excess adhesive material can break longitudinally of the length of the channel as the width of the channel expands under temperature changes and so that the unbroken bottom layer of the adhesive material can similarly break, it is necessary that an anti-bonding material be applied to both top and bottom surfaces of the preformed length to provide respective lines of weakness facilitating breaking of the adhesive material at both faces of the preformed lengths.

Some superior concrete materials have recently become available, such as a polymer cement concrete known as "Syncrete", and various polymer concretes devoid of cement. With such materials, neither voids nor spalling of significance usually occurs, and relatively thin films of the adhesive material may be employed on the lower surface of the preformed strip or on the horizontal bottom faces of the channel. In such instances, it may be unnecessary to employ any anti-bonding material. Moreover, the anti-bonding material may be excluded from the top of the preformed length if precautions are taken to place adhesive only on the margins of such top and to prevent excess adhesive from being inadvertently applied to the intermediate portion of such top. In some instances, adhesive may not be required on the top of the preformed strip, thus eliminating the need for anti-bonding material on such top.

Some preformed and relaxed materials, such as various polymer rubber materials, e.g. a commercially available bridge deck waterproofing membrane, have an adhesive surface that may require no additional adhesive for the purposes of this invention. With the aforementioned superior concrete, a preformed and relaxed length of such material may be laid into and along the bottom of a shallow expansion joint channel across the shrinkage control cut or construction joint, without the need for excess adhesive or anti-bonding material, although it may be desirable to apply adhesive material of the previously described type on marginal areas of the top surface of the strip. Such types of preformed and relaxed materials usually have a protective, release sheet over the adhesive surface that is peeled off at the time of installation.

The preformed length is preferably a strip that is rectangular in cross section, with or without an attenuated intermediate portion, and can be wound on itself as a compact roll following forming by extrusion or otherwise so that it can be easily handled prior to installation. If otherwise irregularly formed to have a nonrectangular cross section, a feature of the invention is the utilization of a filler, such as a paper material, to fill out the irregularities and permit stabilized winding into a roll for handling purposes, the filler being removed at the time of installation.

A significant feature of the invention leading to cost advantages in the original installation is the cutting of an installation channel in adjoining concrete slabs that is usually shallow in comparison with conventional installation channel depth (substantially $\frac{1}{4}''-\frac{5}{8}''$ vs. $1\frac{1}{4}''-\frac{1}{2}''$) as customarily used with a bar-backed silicone adhesive joint filler alone. In other words, the invention makes possible the use of such a shallow installation channel, which can be cut by diamond saws, above and across the usual relatively deep shrinkage control cut at the joint. This not only saves on expensive silicone adhesive material, but eliminates the usual flushing and pressure cleaning with water followed by drying. Normally, a backer bar will only be used in replacement joints of the invention having the usual deep-cut installation channels.

THE DRAWINGS

The best mode presently contemplated for carrying out the invention in actuadl practice is illustrated in the accompanying drawings, in which:

FIG. 1 is a fragmentary view in perspective of a highway joint in accordance with the invention looking from a vertical taken perpendicularly across the joint, the view being drawn to a considerably larger scale, with a portion broken out for convenience of illustration;

FIG. 2, a view in perspective of the preformed strip of FIG. 1 shown per se prior to installation in the joint channel, the strip having been wound into a roll for ease of handling;

FIG. 3, a similar view of a corresponding strip preformed with attenuated intermediate section for expansion and contraction;

FIG. 4, another similar view of a strip that is non-rectangular in cross section to which filler material has been applied to produce rectangular cross section for stability of winding into roll formation;

FIG. 5, still another similar view of a strip of different non-rectangular cross section similarly filled for stability of winding; and FIG. 6, a view corresponding to that of FIG. 1 but showing a deeper, conventional joint installation channel with a conventional backer rod below the sealing joint of the invention.

DETAILED DESCRIPTION OF ILLUSTRATED EMBODIMENTS

Figure 1:
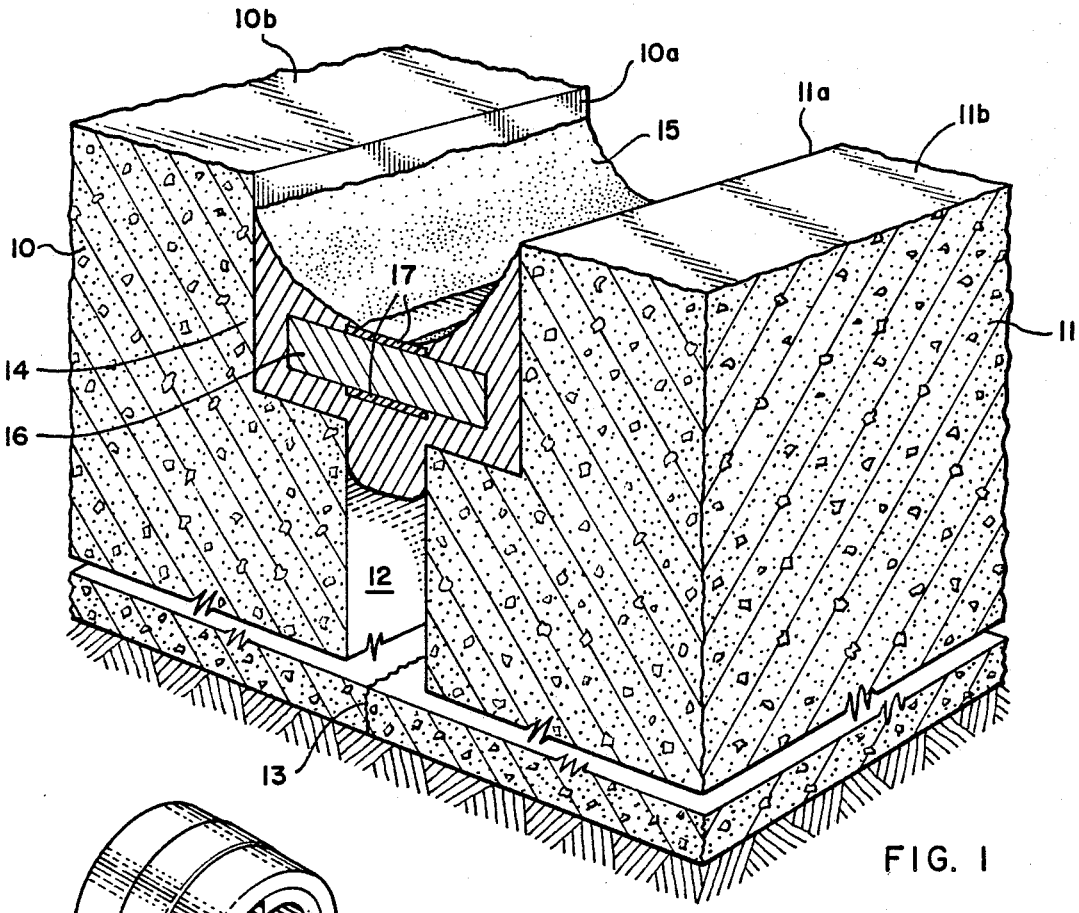

In FIG. 1 is shown a fragmentary section of a typical concrete highway laid down as a continous length in which cuts are made for accommodating expansion and contraction of adjoining concrete slab sections, here indicated 10 and 11, brought about by reason of changing weather conditions. A usual shrinkage control cut 12, typically one-eigth of an inch in width, is first made to a depth of typically three to four inches transversely across or longitudinally of the concrete as laid to a customary depth of from eight to twelve inches. It is common practice tomake the cut 12 by use of a diamond saw. This results in a break 13 through the remaining depth of the concrete to provide the slabs 10 and 11 as separate but closely adjoining entities. A sealing joint installation channel 14 is then cut along the length of and extending across the shrinkage control cut 12.

Figure 6:
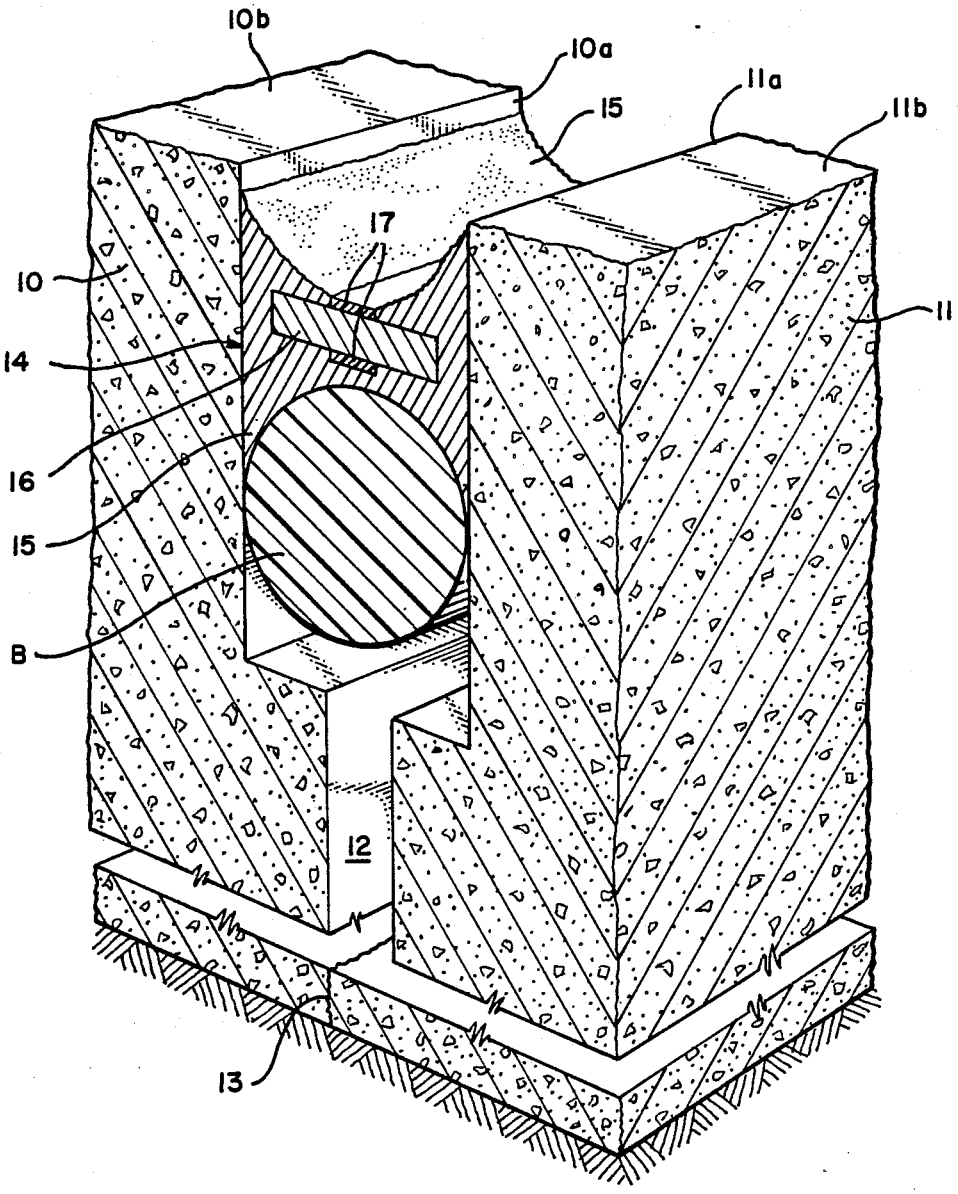

In the present instance, such joint installation channel 14 is made shallower than customary, for the usual backer rod is purposely omitted. However, in some instances, particularly in resealing an existing joint, it may be prefered to make the joint installation channel of usual depth and install a backer rod, e.g. in customary manner, followed by installation of a sealing joint of the invention as described hereinafter, all as shown in FIG. 6, with the backer rod indicated by B and other parts by the same reference numbers as in the previous figures.

The joint installation channel 14 may be cut wet, i.e. while flushing the diamond saw with water in customary manner, but is preferably cut dry to save cost and time in flushing and drying. This is possible because of the shallowness of cut, i.e. within a depth range of from about one-quarter to five-eighths of an inch depending upon channel width which may vary between about three-eighths to one-half inch. This width is sufficiently small, or in other words channel 14 is sufficiently narrow, that traffic loads will be carried by the concrete bordering the channel rather than by the material of the sealing joint.

Following dry cutting, the cut channel may be cleaned by sand blasting or high pressure air blast, neither of which requires prolonged drying as in wet cutting or high pressure water blast cleaning. Installation of the sealing joint can take place immediately. However, it may be desirable to apply a coat of a primer material, such as one of the silane or siloxane based penetrating sealers, to prevent loss of moisture from the concrete through the exposed faces of the cut and to improve bond.

As here shown, the sealing joint installed in channel 14 above, along, and across shrinkage control cut 12 comprises a mass 15 of preferably a special field-cured silicone adhesive similar to but stronger in its cured state than are standard forms, both of which are often referred to as RTV silicone. Such silicone is deposited in channel 14, as by a caulking gun. This special variety is commercially obtainable from Mobay Chemical Co., Pittsburgh, Pa., under the commercial designation Mobay Baysilone 400. Dow Chemical Co. makes an RTV silicone under the name of Dow 888, as does General Electric Co. under the name of GE 4404 and Mobay Chemical Co. under the name of Mobay Baysilone Highway Sealant. These are not recommended for use in this invention because of lower than desired strength in the cured state.

Embedded in the mass of adhesive in this embodiment of the invention and extending along channel 14 and across shrinkage control cut 12 is a preformed and heat cured strip length 16 of silicone that can be spoken of as an HTV silicone in contrast to RTV silicone, a field cured adhesive. A usable material of this kind is obtainable from Jamak, Inc., Weatherford, Tex., under the name of Solasil System preformed sealant. For use in the present invention, such preformed strip material should be supplied with thin films 17 of an adhesive anti-bonding material, such as a polyethelene plastic, applied to and along an intermediate area thereof at opposite faces of the strip. Such areas are approximately the width of the shrinkage control cut 12, i.e. about one-eighth of an inch, and positioned so as to be substantially coextensive with the opening of such shrinkage control cut. The width of strip 16 is preferably somewhat less than the width of channel 14, e.g. as shown, to the embedded strip will not only rest upon but will be surrounded by silicone adhesive 15. Thickness of such strip is desirably within the range of about one thirtysecond to about one-eighth of an inch.

Such silicone adhesive 15 should cover marginal portions of the upper surface of strip 16 and should contact the channel-defining side wall faces 10*a* and 11*a* of the adjoining concrete slabs 10 and 11 for bonding thereto, somewhat as illustrated in FIG. 1, but desirably should not cover either the upper or the lower intermediate anti-bonding area 17, although relatively thin portions of such adhesive 15 that may inevitably lap over opposite margins of such areas or even completely thinly cover such areas will be of little concern due to the anti-bonding action of films 17. The adhesive 15 may or may not completely cover the concrete faces 10*a* and 11*a*, but should not rise above or lap over onto the highway surfaces 10*b* and 11*b*. That the bottom of the bed may tend to sag into the shrinkage control cut 12 as shown, is immaterial except for the fact that it is advantageous that a little as possible underlie the anti-bonding area 17.

The intermediate portion of strip 16 covered by anti-bonding films 17 is free for extension and retraction to accommodate extension and retraction of the adjoining slabs of concrete, the opposite marginal portions of the strip being held tightly by the cured adhesive 15.

In making the sealing joint of the invention, strip 16 may be laid onto a predeposited bed of the adhesive 15, or onto beads thereof spaced apart at opposite sides of the opening of shrinkage control cut 12 so there will be a minimum of coverage of the lower anti-bonding film 17, and the remainder of the adhesive added thereafter, or the entire amount of the adhesive may be deposited in installation channel 14 and the strip pushed into place thereafter. In either instance, it is desirable that the strip length, as preformed, for example by extrusion through a suitable die for subsequent curing, e.g. by the application of heat, and following application of anti-bonding films 17 thereto, be would upon itself in roll form as shown in FIGS. 2–5 for convenience in handling and storage prior to sealing joint construction and for ease of installation.

Figure 2:
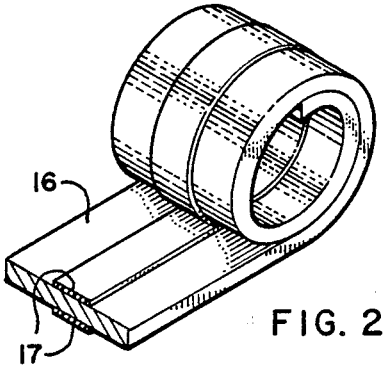
Figure 3:
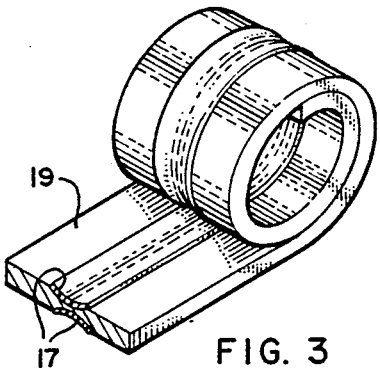
Figure 4:
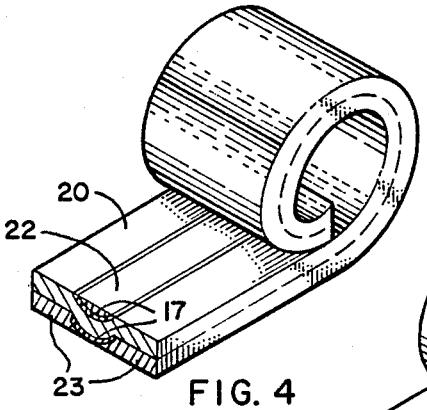
Figure 5:
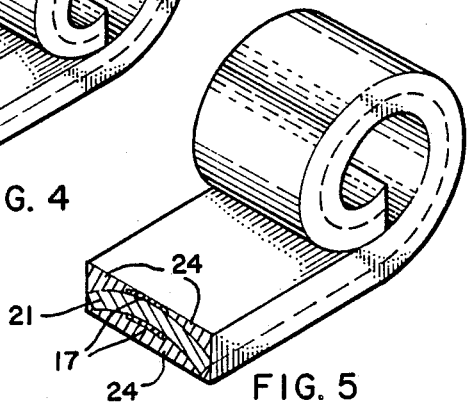

With the strip configurated rectangularly in cross section, as is 16, FIGS. 1 and 2, there is no problem in making a stable roll, or is there a problem when the anti-bonding intermediate area of the strip is attenuated as shown at 18 in the strip 19 of FIG. 3, which strip is of generally rectangular cross-section. However, with other strip shapes that are irregular in the sense that they are non-rectangular in cross-section, winding on themselves would produce an unstable roll. Accordingly, in the latter instance, as shown by the varied shapes of strip 20, FIG. 4, and of strip 21, FIG. 5, which are exemplary of the various possible shapes that the strip may take if found desirable in particular instances, a filler or fillers of some easily stripable and disposable material, such as a preformed paper material, is applied to the strip to make it substantially rectangular in cross section or at least with smooth and parallel flat faces for winding into a stable roll. Thus, in FIG. 4 fillers 22 and 23 are applied to strip 20 before winding into a roll, while FIG. 5 fillers 24 and 25 are applied to strip 21.

When a backer rod is employed, as at B in FIG. 6, it may be of usual type, such as that produced by Hercules Incorporated, Wilmington, Del., under the designation HBR, cylindrical in formation and made up of a foamed plastic material having a surface film of a plastic such as polyethylene. As usual, it may have a diameter slightly greater than the width of the joint installation channel, which in this instance is of greater depth than that of the prior figures, and is pushed downwardly in such channel a desired distance leaving sufficient depth above for installation of the sealing joint of the invention.

Whereas this invention is here illustrated and described with specific reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A sealed joint between adjoining slabs of concrete in a highway or other area subject to vehicular traffic, the slabs being separated by a shrinkage-control cut or by a construction joint, said sealed joint comprising a joint installation channel above and extending along and across said cut or construction joint, said channel having a width sufficiently narrow that traffic loads are carried by the concrete bordering said channel rather than by said sealed joint; a preformed and relaxed length of a ductile and elastic material within said channel bridging and extending along said shrinkage control cut or construction joint; a ductile and elastic type of adhesive bonding said preformed and relaxed length to at least part of the concrete faces of said installation channel, the concrete of the slabs being an ordinary type of concrete having voids at faces of the joint installation channel; and an antibonding material applied to width surfaces of the preformed and relaxed length that bridge and extend along the shrinkage control cut or construction joint and that are covered by the adhesive, said voids being filled by the adhesive.

2. A sealed joint between adjoining slabs of concrete in a highway or other area subject to vehicular traffic, the slabs being separated by a shrinkage-control cut or by a construction joint, said sealed joint comprising a joint installation channel above and extending along and across said cut or construction joint, said channel having a width sufficiently narrow that traffic loads are carried by the concrete bordering said channel rather than by said sealed joint; a preformed and relaxed length of a ductile and elastic material within said channel bridging and extending along said shrinkage control cut or construction joint; and a ductile and elastic type of adhesive bonding said preformed and relaxed length to at least part of the concrete faces of said installation channel, the joint installation channel being unusually shallow in its depth, i.e. in the range of about one-fourth of about five-eighths of an inch, relative to the depth of the shrinkage-control cut or construction joint, and the preformed and relaxed length being bonded at least to the bottom surface of the installation channel.

3. A sealed joint between adjoining slabs of concrete in a highway or other area subject to vehicular traffic, the slabs separated by a shrinkage-control cut or by a construction joint, said sealed joint comprising a joint installation channel above and extending along and across said cut or construction joint, said channel having a width sufficiently narrow that traffic loads are carried by the concrete bordering said channel rather than by said sealed joint; a preformed and relaxed length of a ductile and elastic material within said channel bridging and extending along said shrinkage control cut or construction joint; and a ductile and elastic type of adhesive bonding said preformed and relaxed length to at least part of the concrete faces of said installation channel, the preformed length being a strip rectangular in cross section and in the range of about one thirty-second to about one-eighth of an inch in thickness.

4. A sealed joint according to claim 3, wherein the intermediate portion of the preformed strip is attenuated.

5. A sealed joint between adjoining slabs of concrete in a highway or other area subject to vehicular traffic, the slabs being separated by a shrinkage control cut or by a construction joint, said sealed joint comprising a joint installation channel above and extending along and across said cut or construction joint, said channel having a width sufficiently narrow that traffic loads are carried by the concrete bordering said channel rather than by said sealed joint; a preformed and relaxed length of a ductile and elastic material within said channel bridging and extending along said shrinkage control cut or construction joint; and a ductile and elastic type of adhesive bonding said preformed and relaxed length to at least part of the concrete faces of said installation channel, the width of the joint installation channel being in the range of from about three-eighths to about one-half inch and the depth being substantially in the range of from one-fourth to five-eights of an inch.

6. A sealed joint according to claim 5, wherein a backer rod is positioned in the joint installation channel below the specified components of the sealed joint.

7. A sealed joint according to claim 6, wherein the preformed and relaxed length is bonded to the lateral faces of the installation channel.

8. A sealed joint according to claim 5, wherein the preformed length is a strip rectangular in cross section.

9. A sealed joint according to claim 5, wherein the adhesive is an RTV silicone and the preformed length is an HTV silicone.

10. A sealed joint according to claim 5, wherein the concrete of the slabs is of polymer type substantially without voids at faces of the joint installation channel, and wherein the adhesive material is applied as a film to faces of said channel to which the preformed and relaxed length is bonded, the sealed joint being free of any antibonding material.

11. A sealed joint according to claim 5, wherein the adhesive has ductility less and modulus of elasticity greater than the preformed length.

12. A method of making a sealed joint between adjoining slabs of concrete in a highway or the like that are separated by a shrinkage-control cut or by a construction joint, comprising the steps of forming a sealed joint installation channel above and extending along and across said cut or construction joint, said channel above and extending along and across said cut or construction joint, said channel having a width sufficiently narrow that traffic loads are carried by the concrete bordering said channel; placing a preformed and relaxed length of a ductile and elastic material within said channel bridging and extending along said shrinkage control cut or construction joint; and bonding said preformed and relaxed length to at least part of the concrete faces of said installation channel by means of a ductile and elastic type of adhesive, the preformed and relaxed length being a strip of silicone material wound on itself as a roll and placed in the adhesive as it is being unrolled.

* * * * *